US006487805B1

(12) United States Patent
Reynolds

(10) Patent No.: US 6,487,805 B1
(45) Date of Patent: Dec. 3, 2002

(54) FIREARM ASSEMBLY

(75) Inventor: George L. Reynolds, Altona, IL (US)

(73) Assignee: Armalite, Inc., Genesea, IL (US)

( * ) Notice: Subject to any disclaimer, the term of this patent is extended or adjusted under 35 U.S.C. 154(b) by 0 days.

(21) Appl. No.: 09/574,951

(22) Filed: May 19, 2000

(51) Int. Cl.[7] ..... F41A 21/00
(52) U.S. Cl. ..... 42/75.03
(58) Field of Search ..... 42/75.03, 75.01

(56) References Cited

U.S. PATENT DOCUMENTS

| | | | | |
|---|---|---|---|---|
| 761,463 A | | 5/1904 | Fay | |
| 1,173,582 A | | 2/1916 | Johnson | |
| 1,194,504 A | | 8/1916 | Johnson | |
| 1,373,888 A | | 4/1921 | Johnson | |
| 3,183,617 A | | 5/1965 | Ruger et al. | |
| 3,206,885 A | | 9/1965 | Dye | |
| 3,208,178 A | | 9/1965 | Seiderman | |
| 3,711,983 A | * | 1/1973 | Allyn | 42/75 |
| 3,830,003 A | | 8/1974 | Clerke | |
| 4,282,671 A | | 8/1981 | Wood et al. | |
| 4,312,146 A | | 1/1982 | Koon, Jr. | |
| 4,385,464 A | | 5/1983 | Casull | |
| 4,573,394 A | | 3/1986 | Goff et al. | |
| 4,651,455 A | * | 3/1987 | Geiser | 42/18 |
| 5,410,834 A | * | 5/1995 | Benton et al. | 42/75.02 |
| 5,711,102 A | | 1/1998 | Plaster et al. | |
| 6,301,817 B1 | * | 10/2001 | Hogue et al. | 42/71.01 |

FOREIGN PATENT DOCUMENTS

| | | | | |
|---|---|---|---|---|
| FR | 856051 | * | 5/1940 | 42/75 C |

* cited by examiner

*Primary Examiner*—Michael J. Carone
*Assistant Examiner*—M Thomson
(74) *Attorney, Agent, or Firm*—Woodard, Emhardt, Nauhgton, Moriarty & McNett

(57) ABSTRACT

A firearm assembly includes a stock and an action secured to the stock. The action includes a receiver, a barrel, and a recoil lug that is positionable adjacent a bearing seat of the stock. Various fastener assemblies are provided to assemble the action to the stock with the recoil lug firmly seated against the bearing seat, thus providing longitudinal and torsional stability to the firearm assembly. There is further provided a stock having a bedding portion that includes a surface forming a channel in the bedding block. Either the channel or the receiver includes a number of ribs extending therefrom that support the receiver in the bedding channel when the action is secured to the stock. There is also provided a stock having an action mounting insert. A compressible member is provided between the action mounting insert and the stock.

15 Claims, 10 Drawing Sheets

FIREARM ASSEMBLY

BACKGROUND OF THE INVENTION

The present invention relates generally to firearms, and more particularly to a firearm assembly.

It is often necessary or desirous to disassemble and reassemble the firearm's components in order to, for example, clean the firearm, replace or upgrade components of the firearm, inspect the firearm, or store the firearm. One drawback to disassembling a firearm, particularly with rifles, is that it is difficult to reassemble so that the precision and accuracy of the firearm's shot group is maintained. This is because the component parts of the firearm do not re-seat in the same position that was occupied before disassembly, resulting in movement of the shot group placement and increases in shot group size. Thus, it is necessary to re-zero the rifle after reassembly.

Another drawback with existing methods and devices for assembling firearm is that these techniques do not adequately address the problem of the firearm components shifting relative to one another during firing of the firearm. In order for a firearm to maintain its accuracy, vertical and horizontal (transverse to the barrel,) longitudinal (along the barrel,) and torsional stability of the action relative to the stock is necessary. If such stability is not provided, the action and stock can shift relative to one another due to recoil upon firing the firearm, thus degrading accuracy and precision of the shot group.

Vertical and horizontal stability can be achieved by action screws supplying a sufficient vertical force between the action and the stock to establish and maintain sufficient horizontal and vertical securing forces. However, the use of such action screws to obtain and maintain sufficient longitudinal stability is difficult due to high recoil forces that tend to cause the action to rebound off of the stock when the firearm is fired. Oftentimes, the firearm must be fired several times in order for the recoil lug of the action to settle into its seat.

Torsional loads created by the projectile accelerating down the rifled barrel must also be transmitted from the action to the stock without rotational slippage of the action with respect to the stock. Actions having round bottom receivers, while providing good horizontal stability, do not provide adequate torsional stability, resulting in slippage of the receiver with respect to the stock. Actions with flat bottom receivers better provide torsional stability, but horizontal stability is reduced when compared with round bottom receivers.

One technique for assembling a rifle uses a liquified plastic bedding material that is applied between the stock and action. A release agent is applied to the action to prevent the action from bonding to the cured plastic. The liquified plastic is then applied to the stock, and the action is then placed into position on the stock. After the liquified plastic bedding has set, the action and stock are finally assembled by securely tightening the action screws to draw the action into firm vertical contact with the stock. Despite the intimate fit obtained in this technique, it is often necessary to fire several rounds in order to bring the recoil transmitting surfaces into a relationship that adequately resists longitudinal and torsional loading.

A further drawback with existing firearms is that the firearm shot group typically shifts when fired from different mounting conditions. If the firearm is zeroed from a soft rest, the firearm will exhibit a certain zero. When the firearm is subsequently fired from a hard rest, the zero of the shot group will move due to the differing reactions of the barrel and action when the firearm is fired from different supports.

What is needed therefore is a firearm assembly that allows the firearm to be disassembled and re-assembled in an efficient and repeatable manner while maintaining the precision and accuracy of the firearm's shot group. There is also needed a firearm assembly that provides adequate longitudinal and torsional stability between the firearm components when the firearm is assembled. There is further needed a firearm assembly that provides an accurate and precise shot group without a requirement that several rounds be fired after the firearm is assembled. There is additionally needed a firearm assembly that will provide a precise and accurate shot group whether the firearm is fired from a soft or hard rest. The present invention is directed towards meeting these needs, among others.

SUMMARY OF THE INVENTION

According to one aspect of the invention, a firearm assembly is provided that includes a stock having an action mounting portion with a bearing seat. The firearm assembly further includes a barrel and a receiver coupled to the rearward end of the barrel. A recoil lug is positioned between the receiver and the barrel. The recoil lug has a portion that extends downwardly from the receiver. The downwardly extending portion of the recoil lug has a rearward face positionable adjacent the bearing seat of the stock when the receiver is placed on the action mounting portion of the stock. A fastener assembly contacts a forward face of the recoil lug and applies a rearwardly directed pre-load against the forward face of the recoil lug to secure the recoil lug against the bearing seat.

According to another aspect of the invention, a firearm assembly includes a barrel and a receiver coupled to the rearward end of the barrel. The firearm assembly also includes a stock with an action mounting portion that includes a bedding block with an upper surface forming a bedding channel having opposite sides extending in the direction of the longitudinal axis of the firearm assembly. A pair of ribs each extend along one of the sides of the channel and support the receiver in the bedding channel when the receiver is mounted on said stock.

In one embodiment, the pair of ribs are formed on the upper surface of the bedding block. In a further embodiment, the bedding block also includes a pair of lower ribs each extending from the upper surface along a side of the bedding channel. The receiver is initially supported in the bedding channel by the pair of ribs such that a gap is formed between the receiver and the pair of lower ribs. A bedding fastener extends through an opening in the bedding block and into a passage formed in the receiver. The bedding fastener is operable to draw the receiver into contact with the pair of lower ribs in the bedding channel.

According to another aspect of the invention, a firearm assembly includes a stock with a receptacle formed therein. An action mounting insert coupled to an action is positionable in the receptacle of the stock. A compressible member is placed in the receptacle between the action mounting insert and the stock to isolate the action from the rest support of the firearm assembly. In a preferred form, the compressible member is elastic.

Various methods for assembling a firearm are also provided.

These and other forms, embodiments, aspects, features, objects and advantages of the invention will be apparent from the following description of the preferred embodiments.

BRIEF DESCRIPTION OF THE DRAWINGS

FIG. 10(*a*) is a portion of the firearm assembly of FIG. 10 in an assembled condition.

FIGS. 11(*a*) and 11(*b*) are each enlarged detail views of a portion of FIG. 11.

FIGS. 12(*a*) and 12(*b*) are each enlarged detail views of a portion of FIG. 12.

FIG. 13(*a*) is an enlarged detail view of a portion of FIG. 13.

DESCRIPTION OF THE ILLUSTRATED EMBODIMENTS

Figure 1:
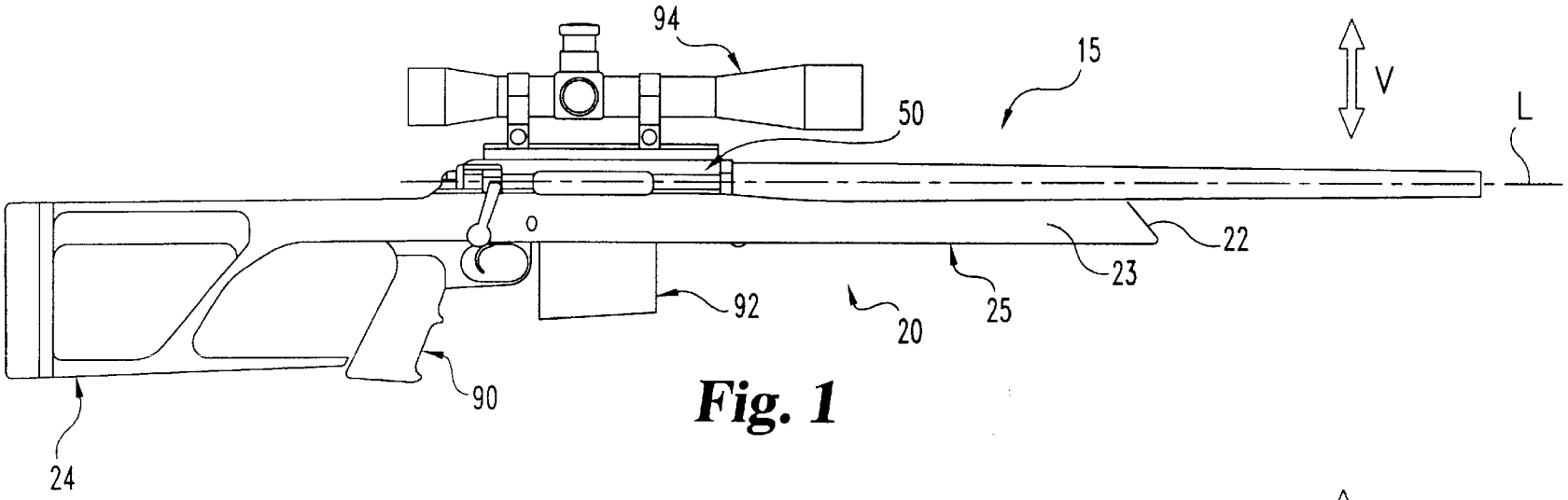
FIG. 1 is a side elevational view of a firearm to which the present invention has application.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any such alterations and further modifications in the illustrated devices, and such further applications of the principles of the invention as illustrated therein are contemplated as would normally occur to one skilled in the art to which the invention relates.

The present invention relates to methods and apparatus for assembling a firearm action group to a stock or action mounting portion secured to a stock. The firearm assembly provides a stable and secure assembly that maintains rigid contact and resists movement between the action group and the stock in each of the vertical, horizontal, longitudinal and torsional directions. Furthermore, the invention permits the action group to be positioned on the stock when the firearm is reassembled so that accuracy and precision of the reassembled firearm is maintained.

Referring now to FIG. 1, there is illustrated a firearm 15 to which the present invention has application. Firearm 15 is illustrated generally as a 0.30 caliber bolt action rifle. However, it should be understood that present invention has application with many types of firearms including, for example, non-bolt action rifles or any other firearm in which the action is secured to the stock. Firearm 15 includes a mounting platform or stock 20 and an action group 50 mounted on stock 20. A handgrip 90 is secured to the bottom of action 50. Firearm 15 further includes a scope 94 secured to the top of action 50, and a magazine 92 positioned in a receptacle (not shown) formed in the bottom of action 50.

Figure 2:
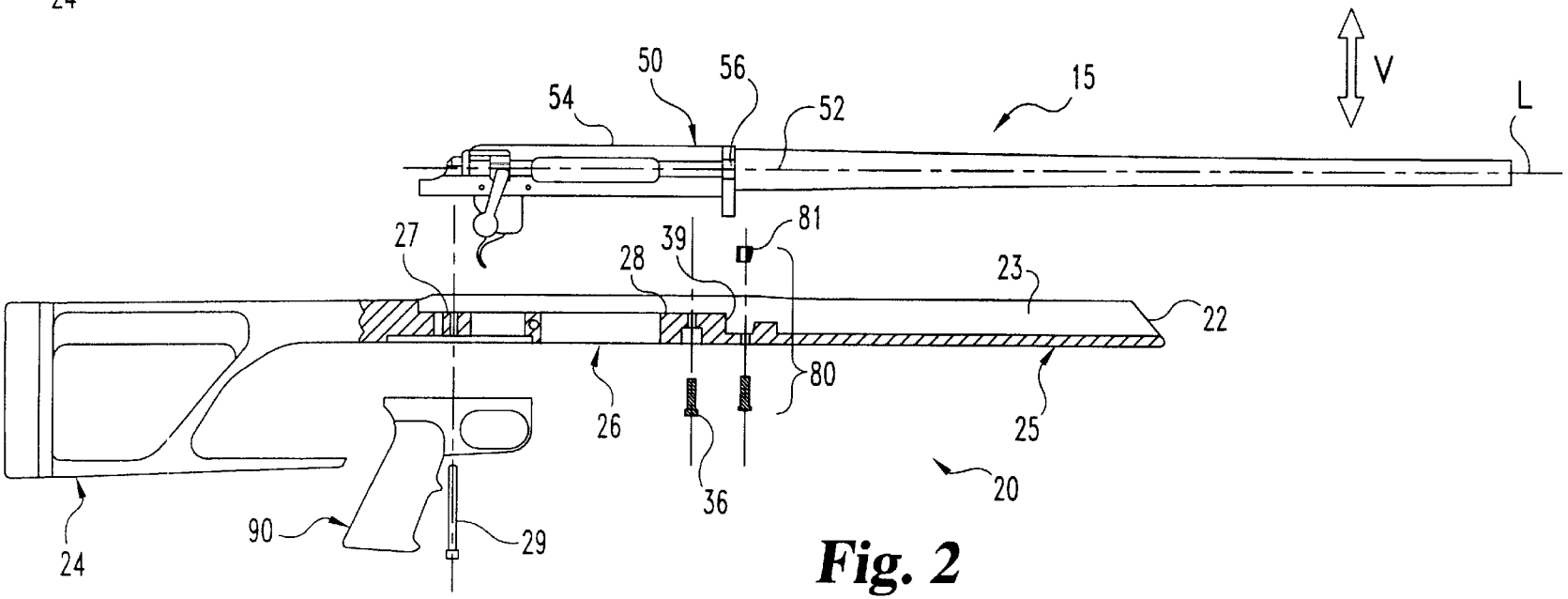
FIG. 2 is an exploded partial sectional side elevational view of the firearm of FIG. 1 according to one embodiment firearm assembly of the present invention.

Referring now further to FIG. 2, action 50 includes barrel 52 extending forwardly from a receiver 54. A recoil lug 56 is positioned between barrel 52 and receiver 54. Firearm 15 has a longitudinal axis L extending through action group 50 along the centerline of barrel 52. As used herein, upwardly, downwardly and/or vertically generally refer to the directions indicated by arrow V when the firearm is positioned for firing. Horizontally generally refers to the direction transverse to each of the directions indicated by arrow V and axis L. Forwardly refers generally to the direction the firearm is pointed and the rearwardly generally refers to the direction towards the shooter's body.

Stock 20 includes a fore stock 22, a butt stock 24, and an action mounting portion 26 therebetween. Fore stock 22 includes sidewalls 23 and a bottom member 25 extending between sidewalls 23. Action mounting portion 26 includes a rearward bedding portion 27 and a forward bedding portion 28. In this embodiment, forward bedding portion 28 and rearward bedding portion 27 are integrally formed with stock 20 via application machining a single piece of metal. However, forward bedding portion 28 and rearward bedding portion 27 can also be separate components that are secured to stock 20. Action 50 and handgrip 90 are secured to rearward portion 27 via rear fastener 29, and action 50 is secured to forward bedding portion 28 via bedding fastener 36. As explained further below, a fastener assembly 80 is provided to secure recoil lug 56 of action 50 to action mounting portion 26 or an action mounting insert 26'.

Figure 3:
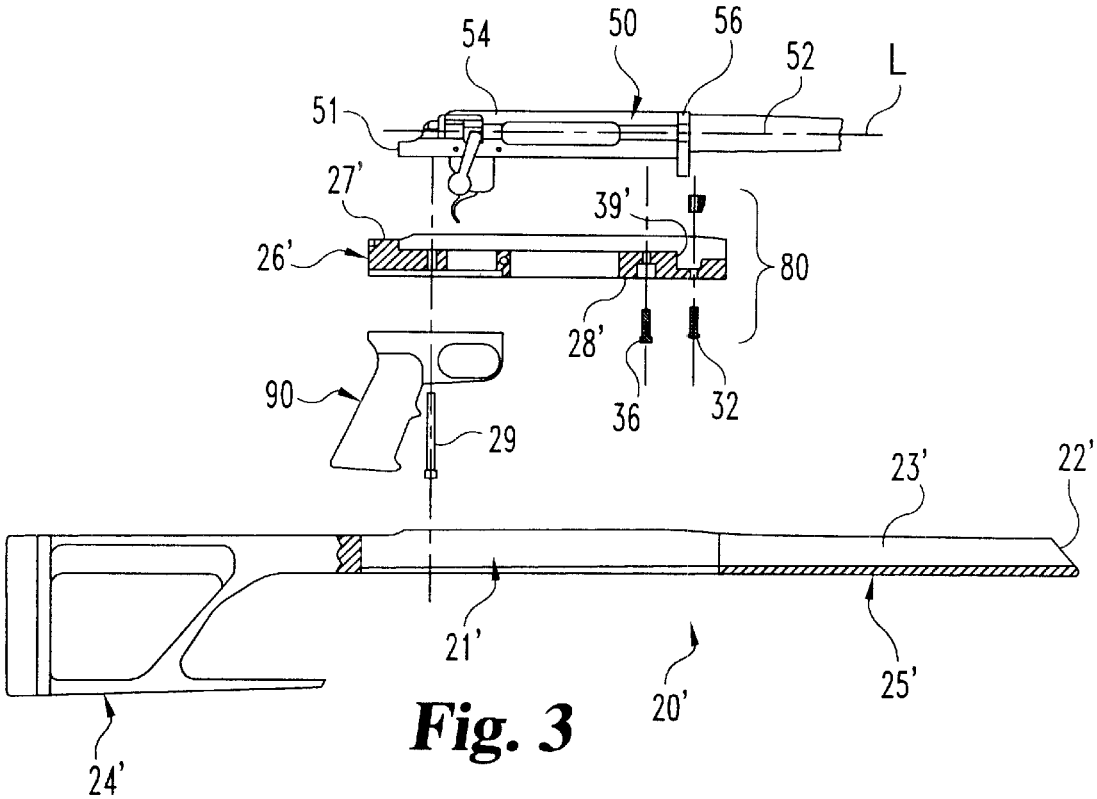
FIG. 3 is an exploded partial sectional side elevational view of a portion of the firearm of FIG. 1 according to another embodiment firearm assembly of the present invention.
Figure 4:
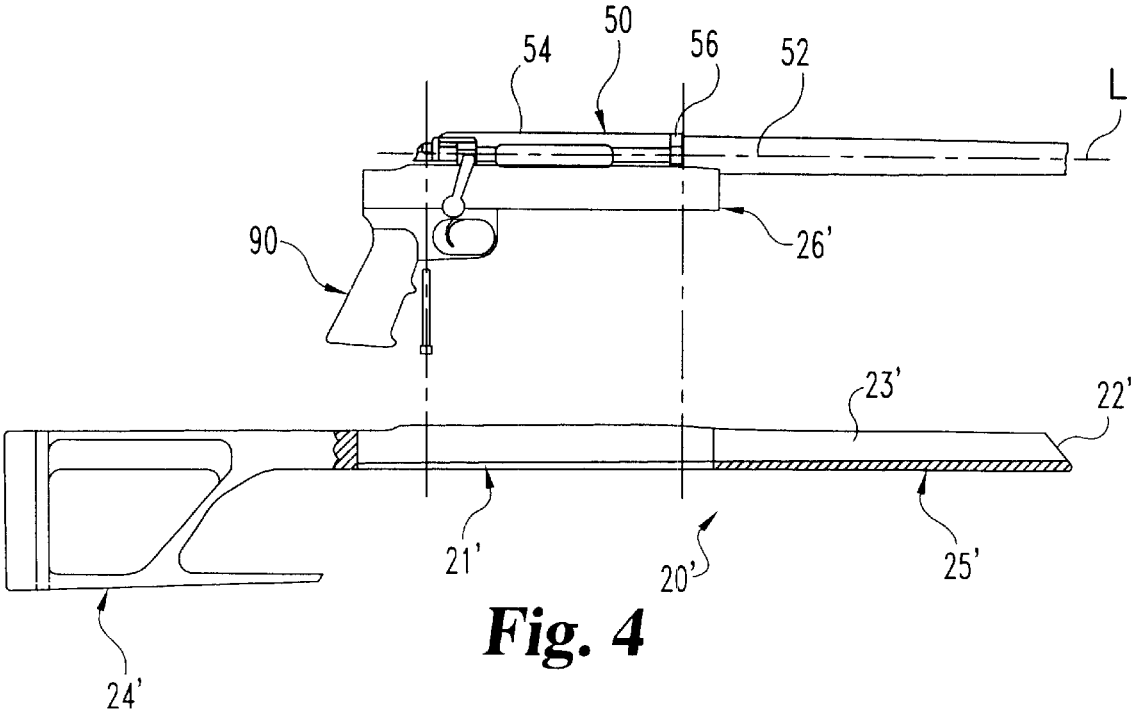
FIG. 4 is the view of FIG. 3 with a portion of the firearm in a partially assembled condition.

Referring now to FIGS. 3 and 4, an alternate action mounting portion in the form of mounting insert 26' is illustrated as a component that is positionable in a bedding block receptacle 21' of stock 20' . Except as otherwise described, stock 20' is similar to stock 20, and like components are referenced with the same reference numerals. Action mounting insert 26' has a configuration substantially the same as action mounting portion 26, and includes a forward bedding portion 28' to which action 50 is secured via bedding fastener 36 and a rearward bedding portion 27' to which action 50 and handgrip 90 are secured via rear fastener 29. Action mounting insert 26' is positionable in receptacle 21' and secured to stock 20' via a rigid epoxy adhesive or other fastening means known to those skilled in the art. Fastener assembly 80 is positionable between recoil lug 56 of action 50 and a forward block 40' of bedding portion 28' via wedge fastener 32.

Figure 5:
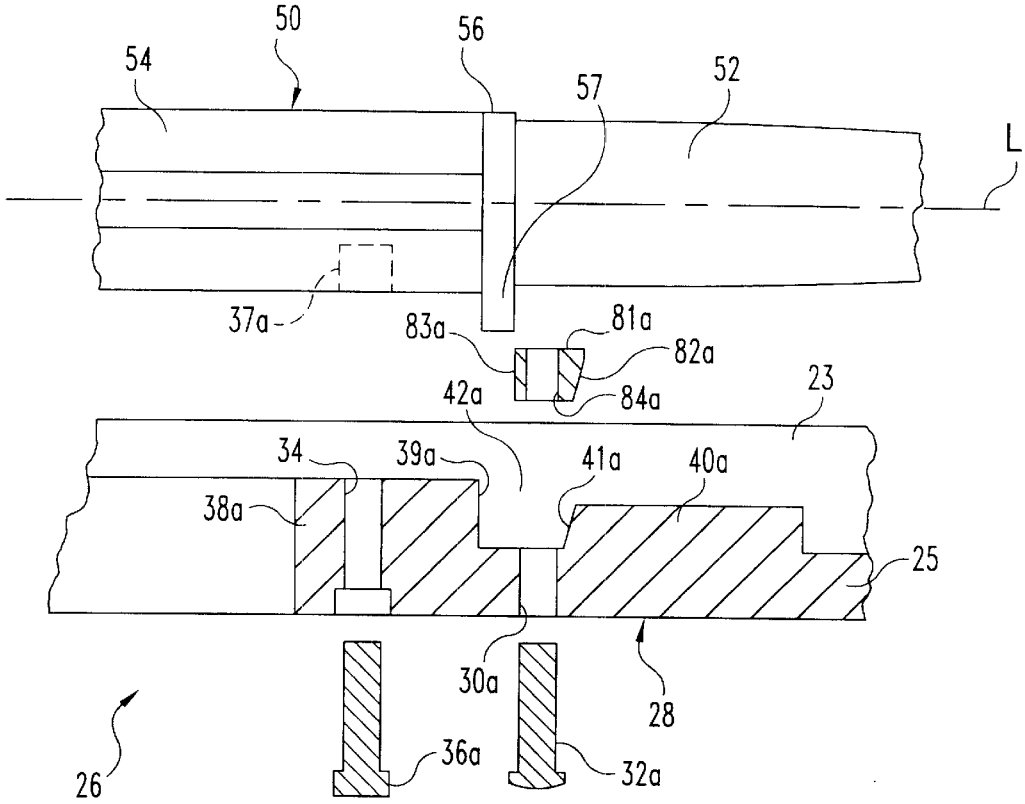
FIG. 5 is an enlarged view of a portion of the firearm of FIG. 2.
Figure 6:
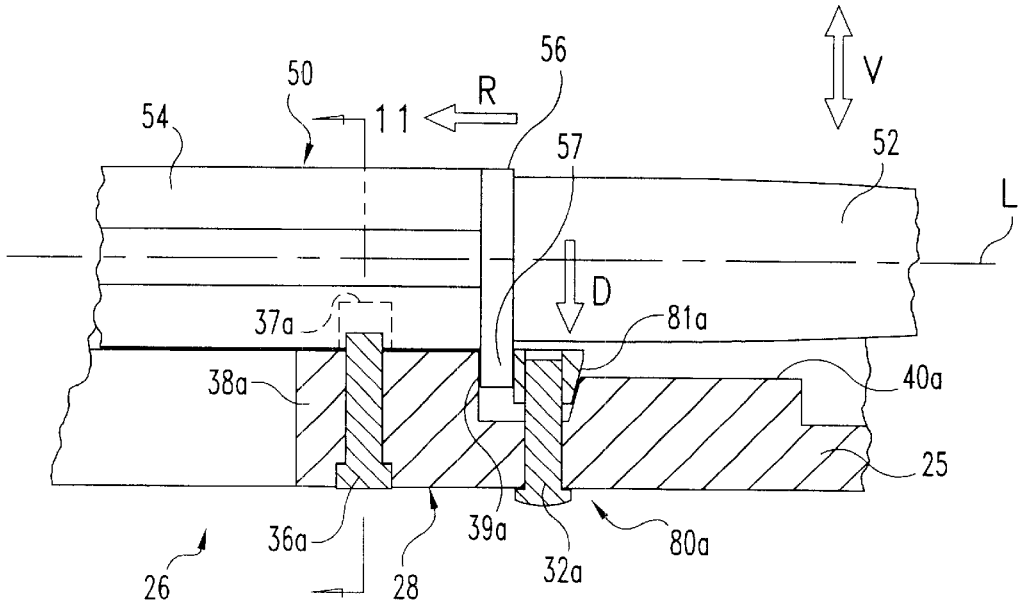
FIG. 6 is the portion of the firearm of FIG. 5 in an assembled condition.

Referring now to FIGS. 5 and 6, there is illustrated an enlarged partial section, partial elevation view of action 50, action mounting portion 26 and a first embodiment of fastener assembly 80. The elements of FIGS. 5 and 6 similar to those of FIGS. 1–4 are similarly designated with the same reference numeral along with the sub-designation "a" to indicate reference to this embodiment of fastener assembly 80. The details of fastener assembly 80 are described hereinbelow with reference to action mounting portion 26 of stock 20; however, it should be understood that fastener assembly 80 can also be provided with action mounting insert 26' of stock 20'.

Action mounting portion 26 includes a bedding block 38*a*, a forward block 40*a*, and a groove 42*a* between bedding block 38*a* and forward block 40*a*. A bearing seat 39*a* is provided on a forward face of bedding block 38*a*, and a cam surface 41*a* is provided on a rearward face of forward block 40*a*. Recoil lug 56 includes a downwardly extending portion 57 that is positionable in groove 42*a*.

Fastener assembly 80*a* includes a wedge 81*a* that is positionable between recoil lug 56 of action 50 and cam surface 41*a* of action mounting portion 26. Wedge 81*a* has an internal passage 84*a* extending at least partially therethrough that is threaded to mate with a threaded portion of a wedge fastener 32*a*. Wedge 81*a* further includes a forwardly facing inclined surface 82*a* obliquely oriented and transverse to longitudinal axis L. A contact surface 83*a* is opposite inclined surface 82*a*. Inclined surface 82*a* of wedge 81*a* slidingly contacts cam surface 41*a* and slides therealong as wedge fastener 32*a* is threaded into passage 84*a*.

Action mounting portion 26 has a first opening 30*a* extending therethrough receiving wedge fastener 32*a*. Wedge fastener 32*a* is preferably a screw having at least a threaded end portion to threadingly engage passage 84*a* of wedge 81*a*. Also provided are one or more bedding block fasteners 36*a* received through a second opening 34*a* formed through bedding block 38*a* of action mounting portion 26. Fastener 36*a* preferably has at least a threaded end portion that projects into a threaded receptacle 37*a* formed in action 54.

As shown in FIG. 6, bedding block fastener 36*a* has been inserted through opening 34*a* and into receptacle 37*a*, and tightened to vertically secure action 50 in bearing contact with bedding block 38*a*. Wedge fastener 32*a* is inserted through opening 30*a* and into passage 84*a* of wedge 81*a*. Fastener 32*a* is threaded vertically in passage 84*a* to pull wedge 81*a* downwardly along cam surface 41*a*, as indicated by arrow D. This forces action 50 rearwardly, as indicated by arrow R, by pushing contact surface 83*a* against downwardly extending portion 57, and pushing recoil lug 56 rearwardly into bearing contact with bearing seat 39*a*. In practice, the wedge fastener 32*a* and bedding fastener 36*a* are alternately tightened to uniformly increase the tightness of the connection between action 50 and action mounting portion 26 in both the vertical and longitudinal directions.

Rear fastener 29 and bedding block fastener 36 provide horizontal and vertical stability between action 50 and action mounting portion 26 or insert 26'. Fastener assembly 80 provides longitudinal and torsional stability to the assembly of action 50 and action mounting portion 26 or insert 26' by applying a longitudinally directed pre-load that maintains recoil lug 56 in firm contact with bearing seat 39. This longitudinal and torsional stability does not depend on the frictional resistance created by the vertical forces applied by fasteners 29 and 36. It is contemplated that the longitudinally directed pre-load applied by fastener assembly 80 can be greater than the recoil load generated upon firing the firearm, preventing the action from rebounding or otherwise moving with respect to bearing seat 39, 39' when the firearm is fired. It is further contemplated that fastener assembly 80 ensures that action 50 will be secured to action mounting portion 26 or insert 26' in the same longitudinal bearing relationship each time the firearm is assembled. Further, fasteners 29 and 36 need not be as tightly torqued as compared to firearms not employing fastener assembly 80 since frictional resistance is not required to provide longitudinal and torsional stability.

Figure 7:
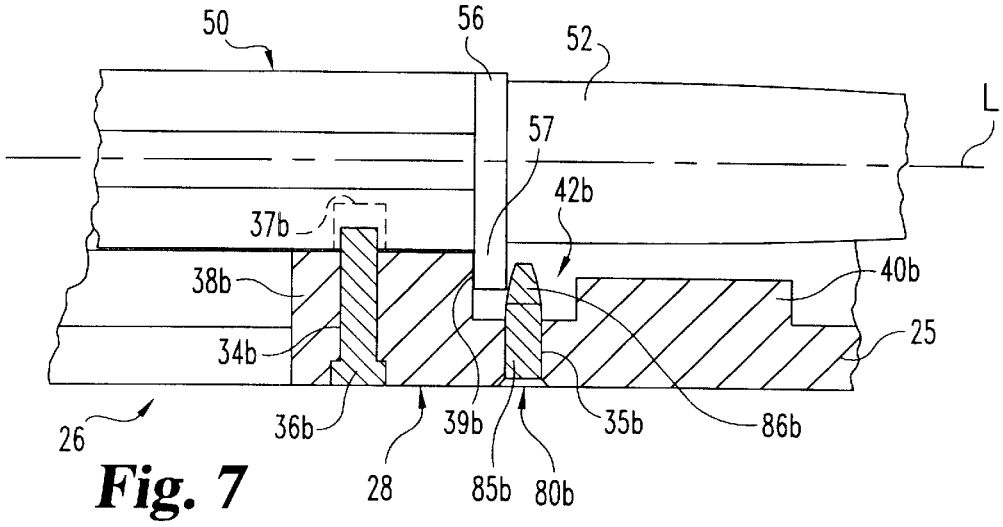
FIG. 7 is the portion of the firearm of FIG. 6 according to a further embodiment firearm assembly of the present invention.

Referring now to FIG. 7, an alternate embodiment of fastener assembly 80 is provided. The elements of FIG. 7 similar to those of FIGS. 1–6 are similarly designated with the same reference numeral along with the sub-designation "b" to indicate correspondence to this embodiment of fastener assembly 80. Fastener assembly 80*b* includes a wedge fastener 85*b* having a tapered end portion 86*b*. In the illustrated embodiment, end portion 86*b* has a truncated frusto-conical shape. Downwardly extending portion 57 of recoil lug 56 is positioned in groove 42*b* between bedding block 38*b* and forward block 40*b*. Wedge fastener 85*b* is threaded vertically into opening 35*b* so that end portion 86*b* contacts downwardly extending portion 57 of recoil lug 56. As wedge fastener 85*b* is threaded vertically into opening 35*b* , end portion 86*b* rides along portion 57, pushing and maintaining recoil lug 56 in firm contact against bearing surface 39*b* to provide longitudinal and torsional stability to the assembly of action 50 and action mounting portion 26 or insert 26'.

Figure 8:
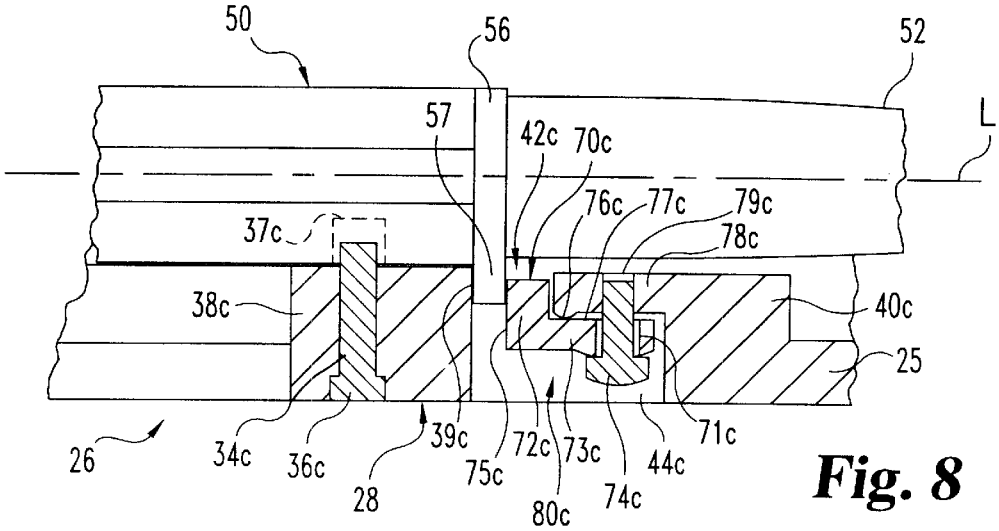
FIG. 8 is the portion of the firearm of FIG. 6 according to yet another embodiment firearm assembly of the present invention.

Referring now to FIG. 8 another embodiment of fastener assembly 80 is illustrated. The elements of FIG. 8 similar to those of FIGS. 1–6 are similarly designated with the same reference numeral along with the sub-designation "c" to indicate correspondence to this embodiment of fastener assembly 80. In this embodiment, forward block 40*c* includes a rearwardly extending cantilevered arm 78*c*. A fulcrum 76*c* is provided in the form of a projection extending downwardly at the rearward end of cantilevered arm 78*c*. Fastener assembly 80*c* includes a lever 70*c* positionable in a notched portion 44*c* formed in the underside of forward block 40*c*. Lever 70*c* includes vertical arm 72*c* having rearward facing contact surface 75*c* positioned to contact downwardly extending portion 57 of recoil lug 56. Lever 70*c* also includes longitudinal arm 73*c* having an upper surface 77*c* in contact with fulcrum 76*c*. A fastener bore 71*c* is formed through arm 73*c* and receives a fastener 74*c* therethrough that extends to a bore 79*c* formed in cantilevered arm 78*c*. Lever 70*c* is rotated or pivoted in a counterclockwise direction about fulcrum 76*c* by threading fastener 74*c* into bore 79*c*. As lever 70*c* is pivoted about fulcrum 76*c*, contact surface 75*c* pushes and maintains recoil lug 56 in firm contact with bearing surface 39*c* to provide longitudinal and torsional stability to the assembly of action 50 and action mounting portion 26 or insert 26'.

Figure 9:
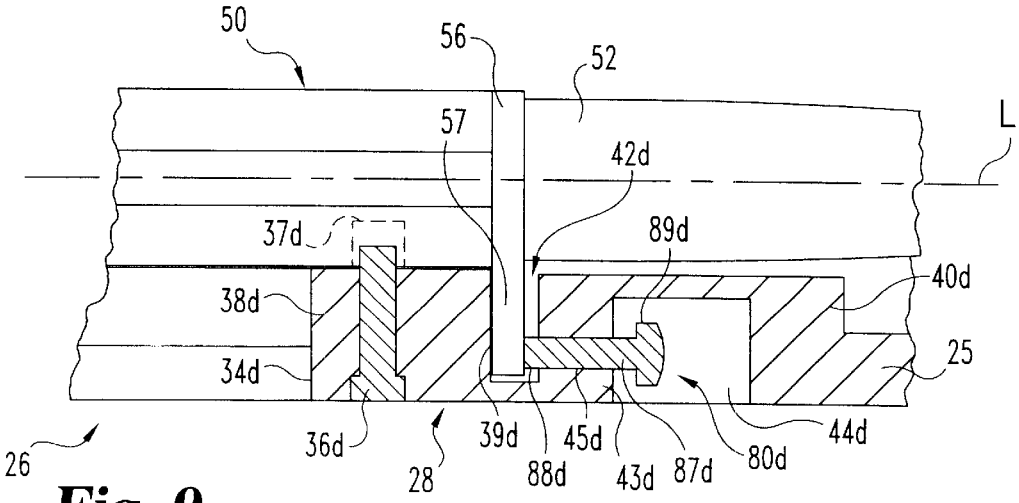
FIG. 9 is the portion of the firearm of FIG. 6 according to a further embodiment firearm assembly of the present invention.

Referring now to FIG. 9 another embodiment of fastener assembly 80 is illustrated. The elements of FIG. 9 similar to those of FIGS. 1–6 are similarly designated with the same reference numeral along with the sub-designation "d" to indicate correspondence to this embodiment of fastener assembly 80. In this embodiment of fastener assembly 80*d*, forward block 40*d* includes a notched portion 44*d* formed in the underside of forward block 40*d*. A rearward lug 43*d* is positioned rearwardly of notched portion 44*d* and includes an opening 45*d* extending longitudinally therethrough to receive a fastener 87*d*. Fastener 87*d* includes an end surface 88*d* contacting downwardly extending portion 57 of recoil lug 56. Fastener 87*d* includes a head 89*d* that is accessible in notched portion 44*d* by a tool. Fastener 87*d* is threaded rearwardly into opening 45*d* to push and maintain recoil lug 56 in firm contact with bearing seat 39*d* to provide longitudinal and torsional stability to the assembly of action 50 and action mounting portion 26 or insert 26'.

Figure 10:
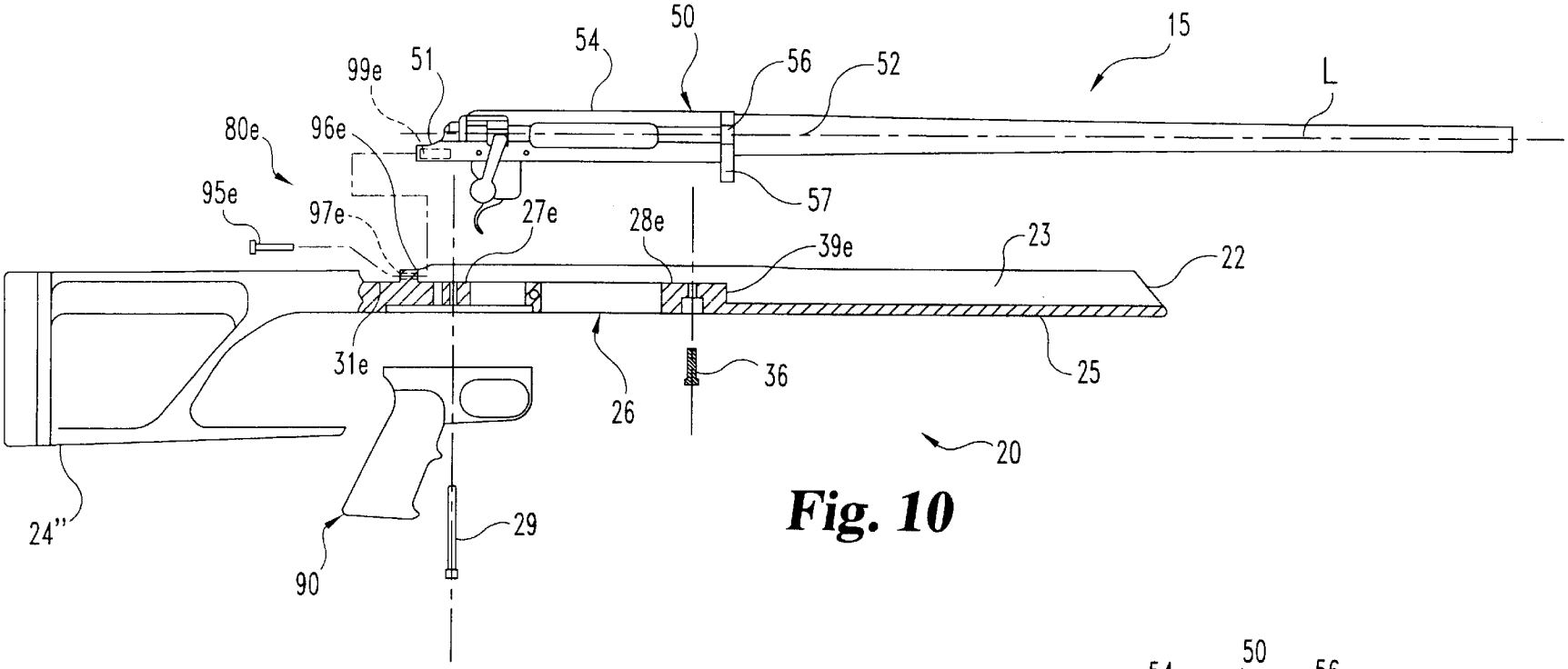
FIG. 10 is the firearm of FIG. 2 according to another embodiment firearm assembly of the present invention.
Figure 10A:
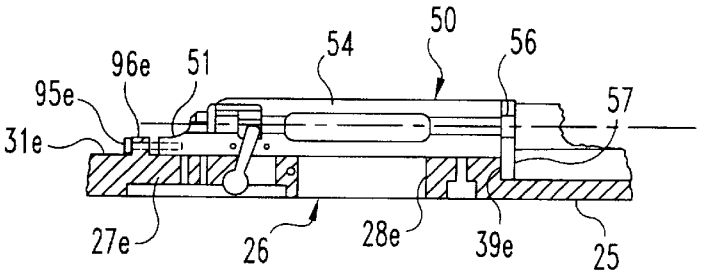

Referring now to FIG. 10 another embodiment of fastener assembly 80 is illustrated. The elements of FIG. 10 similar to those of FIGS. 1–6 are similarly designated with the same reference numeral along with the sub-designation "e" to indicate correspondence to this embodiment of fastener assembly 80. In this embodiment of fastener assembly 80*e*, adjacent rearward bedding portion 27*e* is a notched portion 31*e* formed in the top side of rearward bedding portion 27*e* and a rear lug 96*e* positioned forwardly of notched portion 3l*e*. Rear lug 96*e* has a passage 97*e* formed longitudinally therethrough that receives a fastener 95*e*. A butt end portion 51 of action 50 includes a threaded bore 99*e* formed longitudinally therein to threadingly engage fastener 95*e*. Fastener 95*e* is positionable in notched portion 31*e* and through passage 97*e* for threaded engagement with bore 99*e*. As fastener 95*e* is threaded longitudinally into bore 99*e*, action 50 is drawn rearwardly, and downwardly extending portion 57 of recoil lug 56 is pulled into firm contact with bearing seat 39*e* to provide longitudinal and torsional stability to the assembly of action 50 and action mounting portion 26 or insert 26'. When fastener 95*e* is tightened with recoil lug 56 and bearing seat 39*e* in close contact, there remains a gap between the butt end portion 51 and rear lug 96*e* as shown in FIG. 10(*a*).

It is contemplated herein that each embodiment of fastener assembly 80 described above can be provided in a kit along with the necessary components for the action and stock to retrofit existing firearms in order to provide longitudinal and torsional stability between the action and stock.

Figure 11:
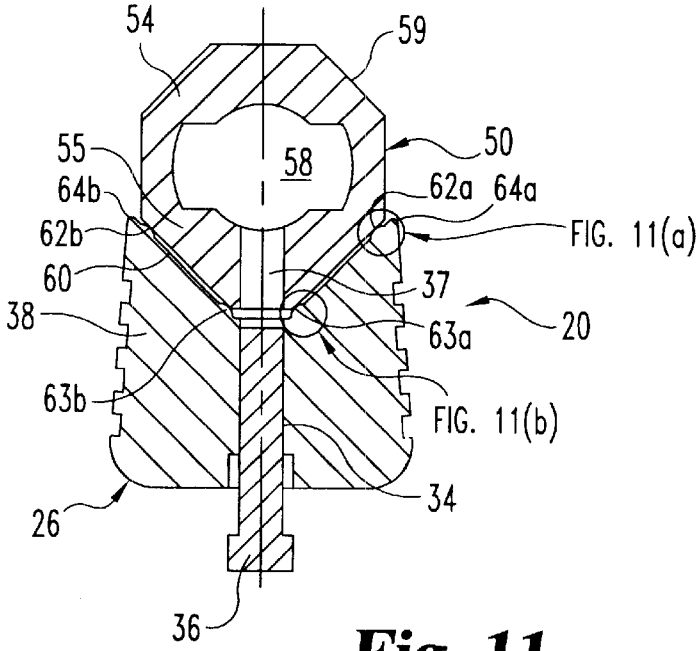
FIG. 11 is a cross sectional view taken through line 11—11 of FIG. 6 of an unsecured firearm assembly according to another embodiment of the present invention having application with the firearm of FIG. 1.

Referring now to FIGS. 11–16, a further aspect of the present invention will now be described. It should be understood that the features described with respect to FIGS. 11–16 can be provided either alone or in combination with fastener assembly 80. FIG. 11 is a cross sectional view taken through line 11—11 of FIG. 6. Action 50 includes receiver 54 having an outer surface 59 and a substantially octagonal shape with an extended lower portion 55. Receiver 54 has an inner bore 58 extending therethrough. Passage 37 is formed in lower portion 55 and extends from outer surface 59 upwardly towards bore 58. Preferably, passage 37 is internally threaded to mate with a threaded end portion of bedding fastener 36.

Action mounting portion 26 has bedding block 38 with opening 34 extending therethrough and alignable with passage 37 of action 50. An upper surface on bedding block 38 forms a recessed truncated V-shaped bedding channel 60 that extends along the length of bedding block 38. A pair of first upper ribs 62*a*, 62*b* are each positioned on a corresponding one of the opposite sides 64*a*, 64*b* of bedding channel 60, and extend upwardly from the upper surface of bedding channel 60 and extend along the length of bedding channel 60 adjacent its upper end. A pair of second lower ribs 63*a*, 63*b* are positioned below upper ribs 62*a*, 62*b* and extend upwardly from the upper surface of bedding channel 60 and extend along the length of bedding channel 60.

Figure 12:
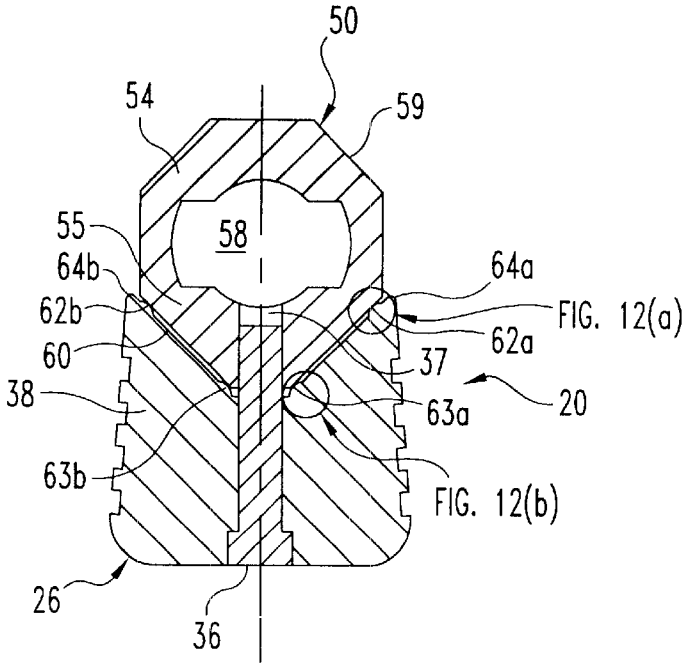
FIG. 12 is the cross sectional view of FIG. 11 after the firearm assembly is secured.
Figure 11A:
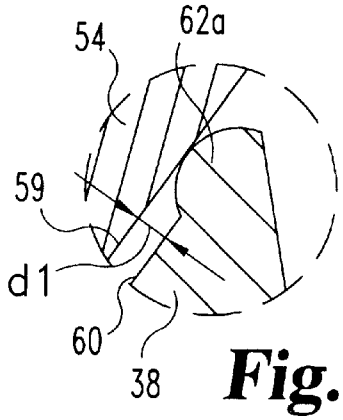
Figure 11B:
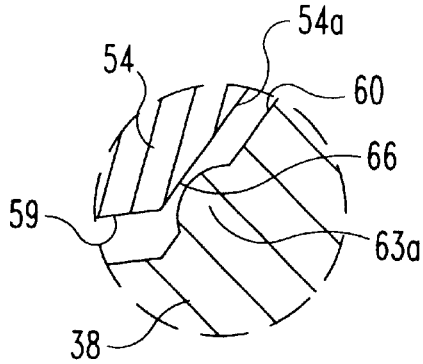
Figure 12A:
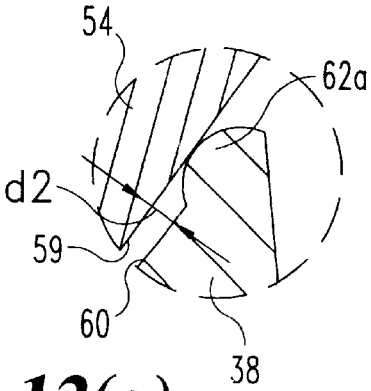
Figure 12B:
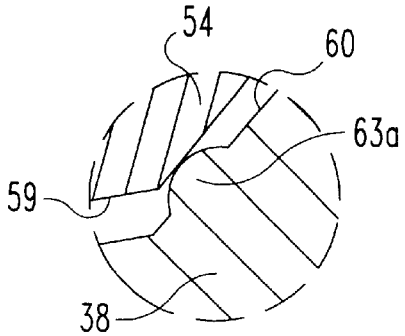
Figure 13:
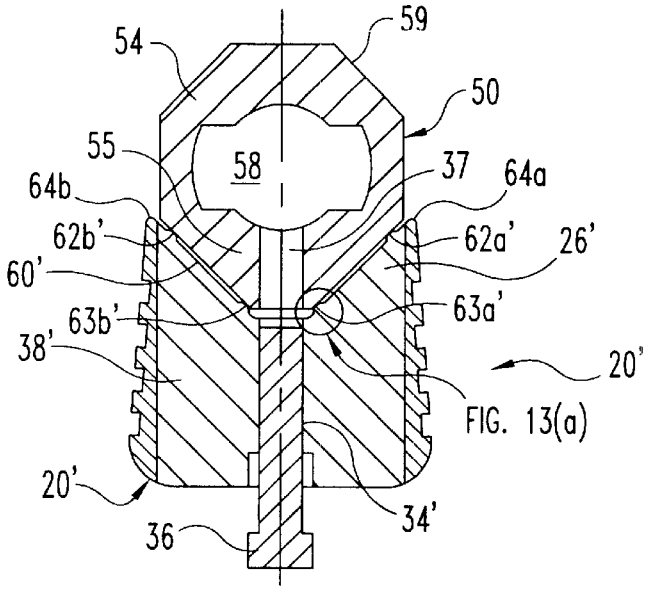
FIG. 13 is a cross sectional view of another embodiment firearm assembly according to the present invention having application with the firearm of FIG. 1.
Figure 13A:
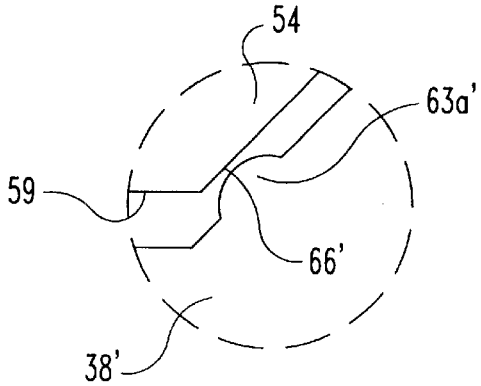
Figure 14:
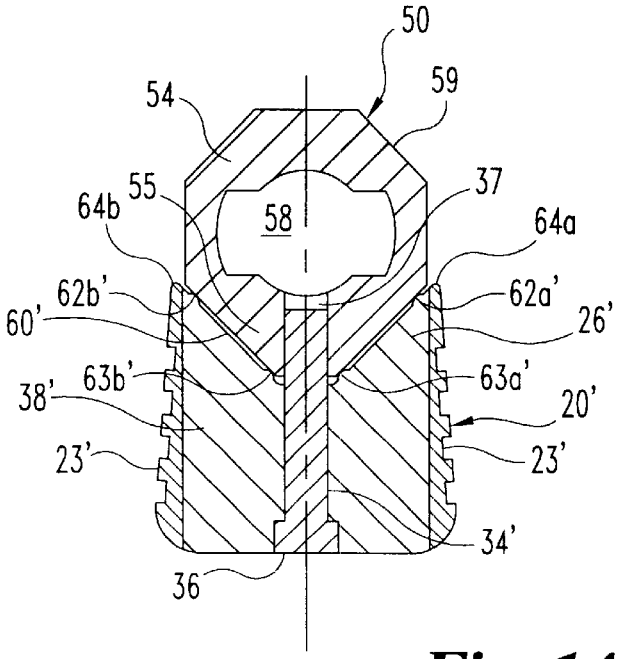
FIG. 14 is the cross sectional view of FIG. 13 after the firearm assembly is secured.

The interface between receiver 54 and channel 60 is such that when receiver 54 is initially positioned in channel 60 with bedding fastener 36 un-tightened, outer surface 59 rests upon upper ribs 62*a*, 62*b* as shown in FIG. 11(*a*), forming an unsecured spacing between channel 60 and outer surface 59 indicated by d1. A gap 66 is formed between lower ribs 63*a*, 63*b* and outer surface 59 as shown in FIG. 11(*b*). In FIG. 12, bedding fastener 36 is tightened by threading fastener 36 into passage 37 of receiver 54. This draws receiver 54 downwardly into bedding channel 60. Sufficient force is exerted via fastener 36 to deform the upper ribs 62*a*, 62*b* and bedding block 38 to close gap 66 as shown in FIG. 12(*b*), providing continuous contact along the length of upper ribs 62*a*, 62*b* and lower ribs 63*a*, 63*b*. Bedding block 38, upper ribs 62*a*, 62*b* and lower ribs 63*a*, 63*b* are preferably elastic to return to their original position when fastener 36 is unsecured. As shown in FIG. 12(*a*), when gap 66 is closed the spacing between the surface of channel 60 and outer surface 59 is indicated by d2, which is less than spacing d1 of FIG. 11(*a*). Lower ribs 63*a*, 63*b* and upper ribs 62*a*, 62*b* thus provides horizontal, vertical, and torsional stability between action 50 and action mounting portion 26 or insert 26', and further provides a bedding location is repeatable each time the firearm is reassembled.

In an alternative form, receiver 54 can be initially supported on lower ribs 63*a*, 63*b* which are then deformed by tightening fastener 36 to provide contact between upper ribs 62*a*, 62*b* and outer surface 59. In a further embodiment shown in FIGS. 13–14, mounting insert 26' includes upper ribs 62*a'*, 62*b'* and lower ribs 63*a'*, 63*b'*. Action 50 is secured in bedding channel 60' of mounting insert 26' via fastener 36 as described above with respect to FIGS. 11–12.

Figure 15:
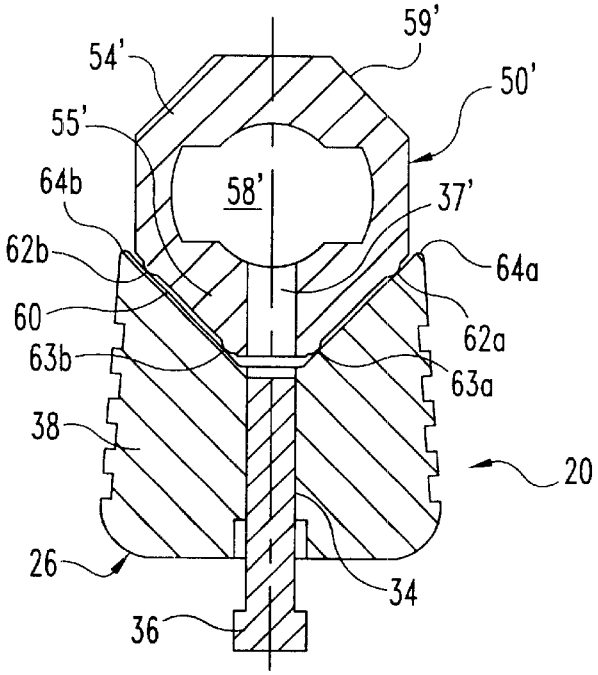
FIG. 15 is a cross sectional view of another embodiment unsecured firearm assembly according to the present invention having application with the firearm of FIG. 1.

In FIG. 15, there is illustrated another embodiment in which upper ribs 62*a*, 62*b* and lower ribs 63*a*, 63*b* are provided on action 50' and extend downwardly from outer surface 59' of receiver 54'. Prior to tightening fastener 36, upper ribs 62*a*, 62*b* support receiver 54' in bedding channel 60, and a gap is formed between the upper surface of channel 60 and lower ribs 63*a*, 63*b*. When fastener 36 is tightened the gap is closed and receiver 54' is supported in bedding channel 60 on upper ribs 62*a*, 62*b* and lower ribs 63*a*, 63*b*.

Figure 16:
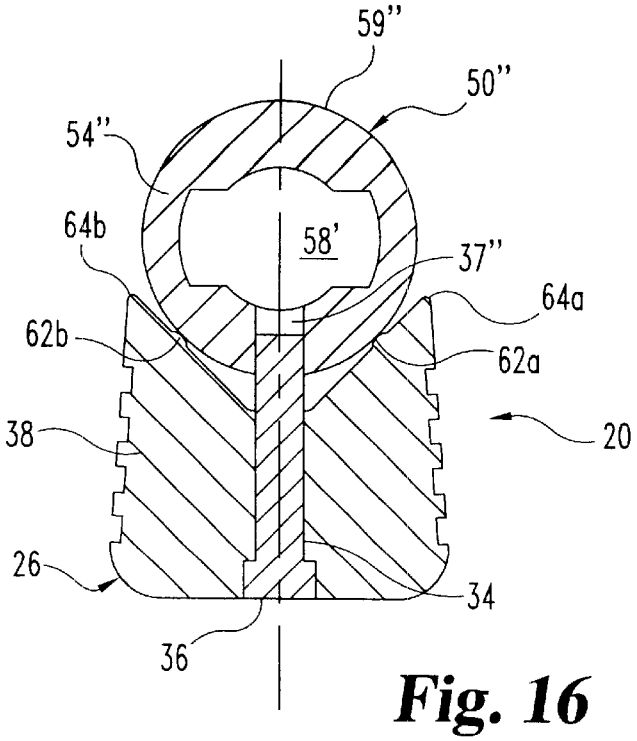
FIG. 16 is a cross sectional view of a further embodiment secured firearm assembly according to the present invention having application with the firearm of FIG. 1.

FIG. 16 illustrates another embodiment where there is provided an action 50" having a receiver 54" having an outer surface 59" that forms a circular cross section. In this embodiment, bedding channel 60 includes opposite ribs 62*a* and 62*b* that support receiver 54" in channel 60 when action 50" is secured to action mounting portion 26 via fastener 36.

It is contemplated herein that each embodiment of the bedding channel described above in FIGS. 11–16 can be provided in a kit along with the necessary components for the action and stock to retrofit existing firearms in order to provide vertical and horizontal stability between the action and stock.

Figure 17:
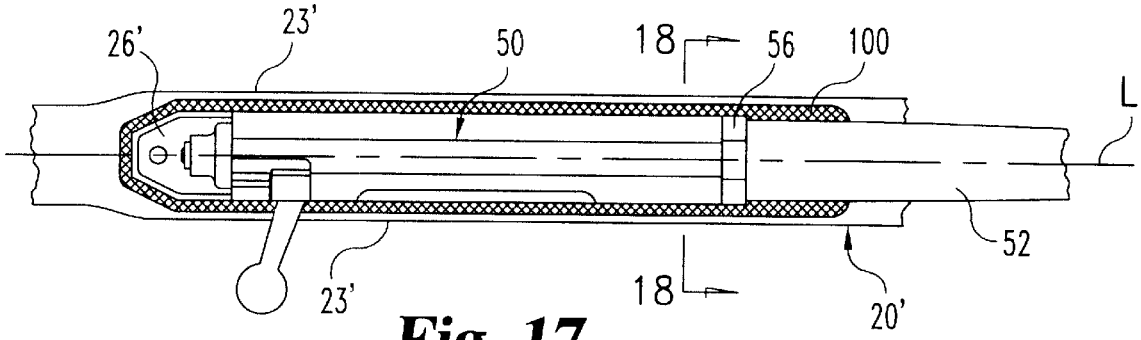
FIG. 17 is a top plan view of another embodiment firearm assembly according to the present invention having application with the firearm of FIG. 1.
Figure 18:
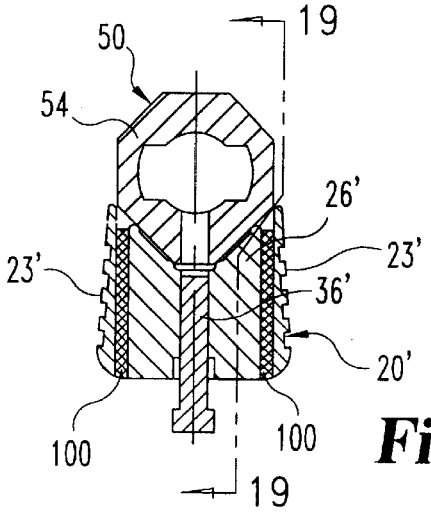
FIG. 18 is a cross sectional view taken along line 18—18 of FIG. 17.
Figure 19:
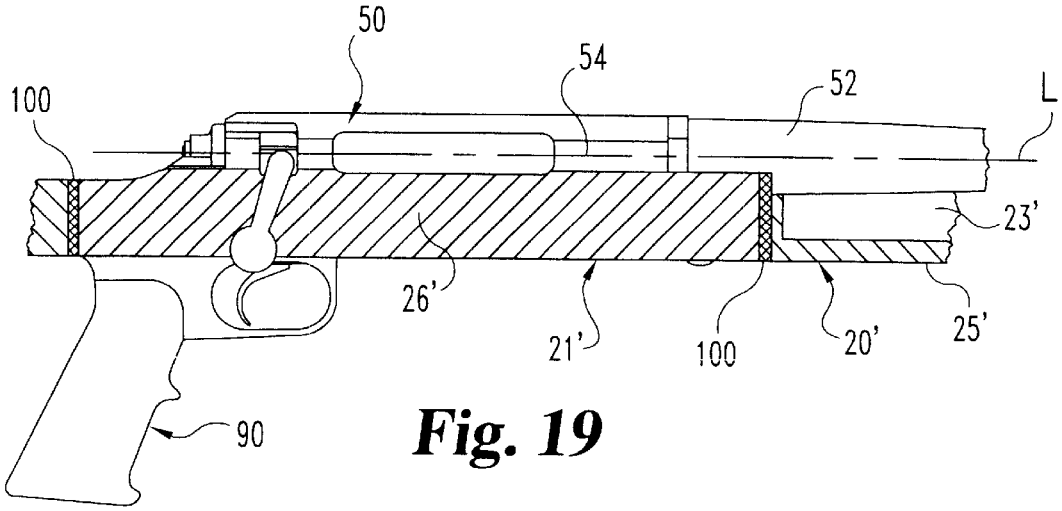
FIG. 19 is a partial cross sectional, partial elevational view taken along line 19—19 of FIG. 18.

Referring now to FIGS. 17–19, there is illustrated a further aspect of the invention relating to the securement of action mounting insert 26' in receptacle 21' of stock 20'. Action 50 is secured to mounting insert 26' as described above or by any technique known to those skilled in the art. A compressible member 100 is placed between action mounting insert 26' and the inner side the walls of receptacle 21'. Compressible member 100 should be placed at least between the forward and rearward walls of receptacle 21 and insert 26', and preferably entirely about insert 26'.

Compressible member 100 allows action mounting insert 26' and action 50 to act as a free body relative to stock 20' at the instant of firing the firearm since compressible member 100 isolates action 50 from hard contact of the rigid support provided by stock 20' and absorbs the recoil load of the firearm. It is contemplated that compressible member 100 will compress several thousandths of an inch at the instant of firing. Compressible member 100 is preferably elastic so it will return to its at rest position after the firearm is fired. Compressible member 100 isolates action 50 from the rigid support of stock 20', maintaining the accuracy and precision of the firearm if the firearm is fired from a hard rest or a soft rest. Compressible member 100 may be made from any material that possesses the requisite properties, including, for example, elastomeric materials or urethane pre-polymers, such as Conathane TU-8080.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A method for securing an action to a stock of a firearm, the method comprising:

providing a stock including a bedding block having a surface defining a bedding channel with opposite sides, the bedding block having a bedding fastener opening formed therethrough;

providing an action including a receiver coupled at a rearward end of a barrel, the receiver having a threaded passage alignable with the bedding fastener opening;

providing a pair of first ribs between the receiver and the bedding channel, each one of the first ribs extending along a corresponding one of the sides of the bedding block;

providing a pair of second ribs between the receiver and the bedding channel, each one of the second ribs extending along a corresponding one of the sides of the bedding block;

supporting the receiver on the opposite sides of the bedding channel with the first ribs contacting the bedding channel and the receiver, and a gap between the second ribs and one of the receiver or the bedding channel;

placing a fastener through the bedding block opening into the threaded passage; and securing the receiver on the bedding block with the fastener so that the second ribs are in contact with the bedding channel and the receiver.

2. The method of claim 1, wherein the pair of first ribs and the pair of second ribs are on the bedding channel.

3. The method of claim 1, wherein the bedding channel has a truncated V-shape.

4. The firearm assembly of claim 1, wherein said receiver has a substantially octagonally-shaped cross-section.

5. A method for securing an action to a stock of a firearm, comprising:

providing a firearm assembly having a barrel extending between a forward end and a rearward end, a receiver coupled to the rearward end of the barrel, the firearm assembly having a longitudinal axis extending along the center of the barrel;

providing a stock having a bedding channel formed therein, the bedding channel having opposite sides extending in the direction of the longitudinal axis;

supporting the receiver in the bedding channel with a first pair of ribs, one of the first pair of ribs extending along one side of the bedding channel and the other of the first pair of ribs extending along the other side of the bedding channel; and supporting the receiver in the bedding channel with a second pair of ribs, one of the second pair of ribs extending along one side of the bedding channel and the other of the second pair of ribs extending along the other side of the bedding channel.

6. The method of claim 5, wherein the receiver is initially supported in the bedding channel by the first pair of ribs such that a gap is formed between the receiver and the second pair of ribs, and further comprising:

securing the receiver in the bedding channel with the receiver in contact with the first pair of ribs and in contact with the second pair of ribs.

7. The method of claim 5, wherein the bedding channel has a truncated V-shape.

8. The method of claim 5, wherein the first pair of ribs and the second pair of ribs are formed on the bedding channel.

9. The method of claim 5, wherein the receiver has a substantially octagonally-shaped cross-section.

10. A method for securing an action to a stock of a firearm, the method comprising:

providing a stock having a surface defining a bedding channel with opposite sides;

providing an action including a receiver coupled at a rearward end of a barrel;

providing a pair of first ribs between the receiver and the bedding channel, each one of the pair of first ribs extending along a corresponding one the sides of the bedding channel;

providing a pair of second ribs between the receiver and the bedding channel, each one of the pair of second ribs extending along a corresponding one of the sides of the bedding channel;

supporting the receiver on the opposite sides of the bedding channel with the pair of first ribs; and securing the receiver on the bedding channel so that the second ribs are in contact with the bedding channel and the receiver.

11. The method of claim 10, wherein the pair of first ribs and the pair of second ribs are on the bedding channel.

12. The method of claim 11, wherein securing the receiver on the bedding block includes engaging a fastener to the stock and the receiver.

13. The method of claim 11, wherein the bedding channel is formed in a bedding block of the stock.

14. The method of claim 11, wherein the bedding channel has a truncated V-shape.

15. The method of claim 11, wherein the receiver has a substantially octagonally-shaped cross-section.

* * * * *